United States Patent [19]

Camillo

[11] Patent Number: 4,856,790

[45] Date of Patent: Aug. 15, 1989

[54] GAME OF SKILL AND METHOD OF PLAYING SAME

[76] Inventor: Jack J. Camillo, 24 Barchester Way, Westfield, N.J. 07090

[21] Appl. No.: 202,221

[22] Filed: Jun. 3, 1988

[51] Int. Cl.[4] ..... A63B 67/00

[52] U.S. Cl. ..... 273/317; 273/108; 273/428; 446/256

[58] Field of Search ..... 273/317, 108, 126 R, 273/424, 428; 446/256

[56] References Cited

U.S. PATENT DOCUMENTS

| | | | |
|---|---|---|---|
| 1,139,119 | 5/1915 | Heidenreich | 446/256 |
| 1,262,061 | 4/1918 | Kristofek | 446/256 |
| 1,317,640 | 9/1919 | Nussbeck | 273/108 |
| 1,319,123 | 10/1919 | Simon | 446/256 X |
| 2,264,492 | 12/1941 | Weaver et al. | 273/108 |
| 2,332,507 | 10/1943 | Dailey | 446/256 X |
| 2,807,470 | 7/1954 | Keuls | 273/282 |
| 3,147,977 | 9/1964 | Glassman | 273/126 R |
| 3,533,626 | 10/1970 | Smith | 273/126 R |
| 3,680,864 | 8/1972 | Peterson | 273/108 X |
| 3,947,035 | 3/1976 | Bouchard | 273/126 R |

FOREIGN PATENT DOCUMENTS

| | | | |
|---|---|---|---|
| 599770 | 6/1960 | Canada | 273/108 |

*Primary Examiner*—William H. Grieb

*Attorney, Agent, or Firm*—Ralph W. Selitto, Jr.

[57] ABSTRACT

A game makes use of top-like game pieces in order to test the manual dexterity and mental acuity of a player who must keep as many game pieces as possible spinning simultaneously on a playing surface. The game pieces are spun by twirling them between the thumb and finger of the player, who then projects them onto the playing surface as they continue to spin. In playing the game, the period of play can terminate upon the expiration of a preselected length of time or when one of the game pieces stops spinning or after a predetermined number of game pieces have been put into play.

27 Claims, 2 Drawing Sheets

GAME OF SKILL AND METHOD OF PLAYING SAME

FIELD OF THE INVENTION

The present invention relates to a game of skill which requires manal dexterity and mental acuity in order to put as many top-like game pieces as possible into concurrent spinning motion on a playing surface.

BACKGROUND OF THE INVENTION

Tops and similar spinning toys have been known for centuries. Many such tops were designed to be spun without the use of strings, cords, rope, etc. (see, for instance, U.S. Pat. Nos. 1,139,119; 1,319,123; 1,262,061 and 2,332,507). These tops typically employed a stem adapted to be gripped between the thumb and finger of a user and then twisted rapidly so as to impart a spinning motion to the top as it was released by the user onto a preferably smooth support surface, which would be contacted by the body of the top or by the tip of a spindle extending from the top's body in an opposite direction from the stem.

U.S. Pat. No. 2,807,470 discloses a game which comprises playing pieces adapted to be positioned on a suitable playing surface. Each game piece includes an elongated pin or post having one end which is adapted for insertion into a selected one of a plurality of apertures formed in the playing surface. The opposite end of each pin or post is adapted to receive a disc-like member which can be spun by a player upon the opposite end of a corresponding pin or post. The object of the game is to place and retain on the playing surface as many game pieces as possible with the disc-like members thereon all spinning simultaneously.

SUMMARY OF THE INVENTION

In accordance with one aspect of the present invention, a game is formed from a combination which includes a playing surface and a plurality of game pieces. Each game piece has a body and a combined stem and spindle which extends outwardly from one side of the body. The combination stem and spindle is provided with a contact surface, such as a pointed tip, adapted to contact or engage the playing surface, and it is also provided with a gripping surface, such as a cylindrical post-like member, adapted to be gripped by a player between his or her thumb and finger and then twirled so as to impart a spinning motion to the game piece. Because the combined stem and spindle contains both the contact surface and the gripping surface, the game piece, in contrast to the tops described above which have separate stems and spindles, cannot be maintained in contact with or in close proximity with the playing surface while being twirled by the player. Rather, the game piece must be projected onto the playing surface in such a manner that the tip of the combined stem and spindle lands on the playing surface as the game piece continues to spin. The act of projecting the spinning game piece onto the playing surface without interrupting the spinning motion of the game piece requires that the player exercise a fair amount of manual dexterity.

In accordance with another aspect of the present invention, various different and unique games can be played using the combination of elements described above. For instance, one possible game involves a single player attempting to spin as many game pieces as possible at one time (i.e., to see how many game pieces can be kept spinning simultaneously). A variant involves two players spinning their respective game pieces on the same game board concurrently or alternately. The playing period of either game can terminate upon the expiration of a preselected length of time or when one of the game pieces stops spinning or after a predetermined number of game pieces have been put into play. Such games, especially those involving simultaneous play by two or more players, introduce the element of mental acuity. That is, a player may elect to implement a strategy whereby his or her game pieces are put into play in such a manner that they avoid each other or the game pieces of an opponent.

BRIEF DESCRIPTION OF THE DRAWINGS

For a better understanding of the present invention, reference is made to the following detailed description of various exemplary embodiments considered in conjunction with the accompanying drawings, in which.

DESCRIPTION OF THE EXEMPLARY EMBODIMENTS

Figure 1:
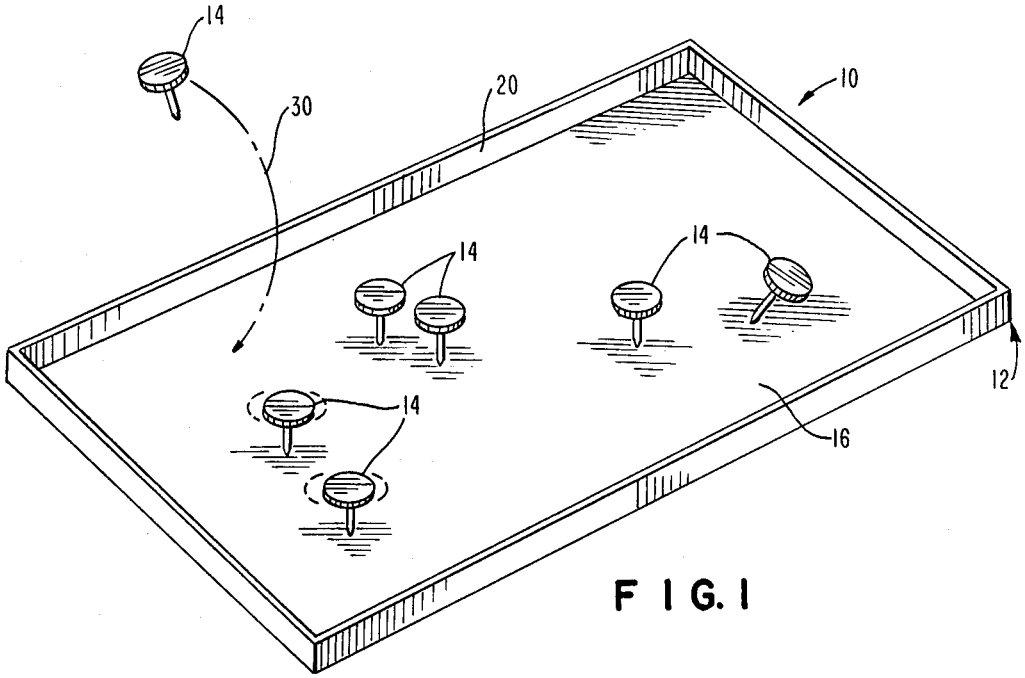
FIG. 1 is a perspective view of one embodiment of a game, including a game board and a plurality of game pieces, constructed in accordance with the present invention.

With reference to FIG. 1, a game 10 includes a game board 12 and a plurality of game pieces 14. Set forth below is a detailed description of the game board 12 followed by a detailed description of the game pieces 14.

Figure 6:
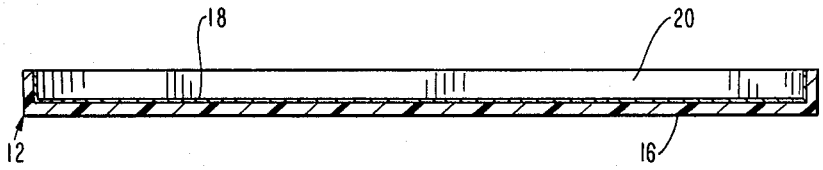
FIG. 6 is a cross-sectional view of the game board illustrated in FIG. 1.
Figure 7:
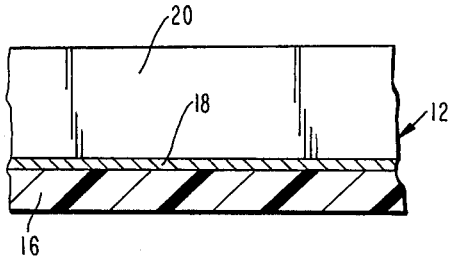
FIG. 7 is a partial cross-sectional view of the game board of FIG. 6, the game board being shown in a larger scale to facilitate consideration and discussion.

Referring to FIGS. 6 and 7 as well as to FIG. 1, the game board 12 includes a rectangular playing surface 16. In order to reduce the friction between the game board 12 and the game pieces 14, the playing surface 16 is coated with a suitable anti-friction material 18, such as Teflon (see FIGS. 6 and 7). A railing 20 extends around the periphery of the playing surface 16 for the purpose of restraining the game pieces 14 from leaving the surface 16. It has been found that a conventional Teflon coated cookie tray will provide a suitable make shift game board.

Figure 2:
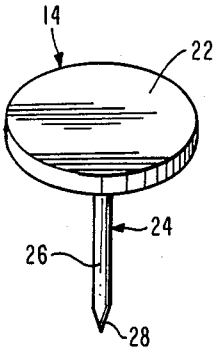
FIG. 2 is a larger scale perspective view of one of the game pieces illustrated in FIG. 1.
Figure 4:
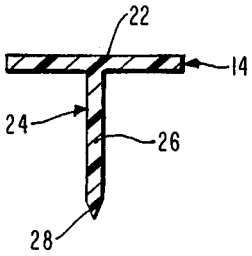
FIG. 4 is cross-sectional view of the game piece illustrated in FIG. 2.

Referring now to FIGS. 2 and 4, each of the game pieces 14 includes a circularly-shaped, disc-like body 22 and a combination stem and spindle 24 extending downwardly from the body 22. The combination stem and spindle 24 has a substantially cylindrical, post-like member 26, which forms a gripping surface adapted to be gripped between the thumb and finger of a player, and a substantially pointed tip 28, which forms a contact surface adapted to contact or engage the playing surface 16 of the game board 12. The game pieces 14 are preferably made out of a durable, lightweight material, such as plastic or aluminum, and are approximately the same size and shape as a conventional golf ball marker, which can function as a ready-made game piece. However, it should be understood that the game pieces 14 can be made out of many different types of material and can have many different sizes and shapes.

In playing the game 10, a player (not shown) grips the combined stem and spindle 24 of one of the game pieces 14 between his or her thumb and finger (preferably the middle finger). The combined stem and spindle 24 is then twirled between the thumb and finger of the player, whereby a spinning motion is imparted to the game piece. Next, the spinning game piece is projected along a path (see, for instance, reference numeral 30 in FIG. 1) onto the playing surface 16 of the game board 12 such that the tip 28 of the combined stem and spindle 24 lands on the playing surface 16 as the game piece continues to spin. Additional game pieces can thereafter be put into play in a similar manner. Hours of amusement and entertainment can be provided as the player attempts to spin as many of the game pieces 14 as possible at one time (i.e., to see how many of the game pieces 14 he or she can keep spinning simultaneously). The playing period can be terminated upon either the expiration of a preselected length of time or when one of the game pieces 14 stops spinning. Alternatively, the player could select a predetermined number of the game pieces 14 (e.g. about fifteen) and then put them into play one at a time. When the last of the game pieces 14 has been put into play, the player's score would be determined based upon the number still spinning.

The game 10 is also suited for simultaneous or alternate play by two or more players. For simultaneous play by two or more players, each player would preferably have his own set of game pieces which could be readily differentiated (for instance, by color, markings or otherwise) from those of his opponent or opponents. As in the case of a single player, the period of play for two or more players can be terminated upon the expiration of a preselected length of time or when one of the game pieces stops spinning or after a predetermined number of game pieces have been put into play. The winner would be the player who has maintained the most game pieces spinning simultaneously during the playing period. Thus, if the playing period is determined by a preselected length of time, it is contemplated that a player would re-spin any game pieces which have stopped spinning.

The game 10 is susceptible to many modifications. Some possible modifications will be specifically described below, while other modifications will be referred to in general terms.

Figure 3:
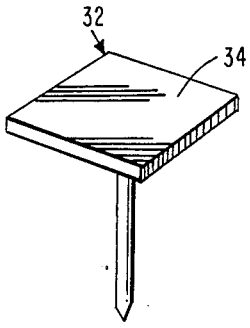
FIG. 3 is a perspective view of a game piece which is a modified version of the game piece of FIG. 2.

With reference to FIG. 3, a modified game piece 32 is shown. The game piece 32 is identical to the game pieces 14, except that the game piece 32 includes a rectangularly-shaped body 34, as compared with the circularly-shaped body 22 of the game pieces 14.

Figure 5:
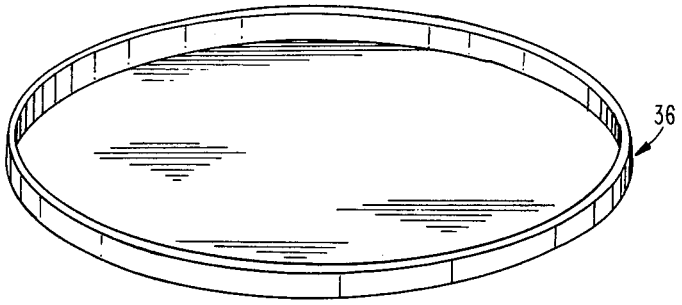
FIG. 5 is a perspective view of a game board which is a modified version of the game board of FIG. 1.

Referring finally to FIG. 5, a modified game board 36 is shown. The game board 36 is identical to the game board 12, except that the game board 36 has a round shape instead of a rectangular shape.

As indicated above, the embodiments specifically described above are merely exemplary and a person skilled in the art may make many variations and modifications without departing from the spirit and scope of the invention. Thus, all such variations and modifications are intended to be included within the scope of the invention as defined in the appended claims.

I claim:

1. In combination, a smooth, obstacle-free playing surface and a plurality of game pieces, each game piece including a body and a combined stem and spindle which extends outwardly from one side of said body, said combined stem and spindle including engaging means for engaging said playing surface and gripping means for gripping by a player between his or her thumb and finger in such a manner that said gripping means can be twirled so as to impart a spinning motion to said game piece while said game piece is projected onto said playing surface such that said engaging means lands on said playing surface as said game piece continues to spin, and each of said game pieces which has been projected onto said playing surface creating an obstacle to be avoided by the other of said game pieces.

2. The combination of claim 1 wherein said playing surface is provided with an anti-friction coating thereon.

3. The combination of claim 1, wherein said playing surface is provided on a game board, said game board including restraining means for restraining said game pieces from leaving said playing surface while said game pieces are spinning thereon.

4. The combination of claim 3, wherein said restraining means is a railing which extends around a peripheral edge of said playing surface.

5. The combination of claim 4, wherein said playing surface has a rectangular shape.

6. The combination of claim 4, wherein said playing surface has a round shape.

7. The combination of claim 1, wherein said body of each of said game pieces has a disc-like shape.

8. The combination of claim 7, wherein said engaging means of each of said game pieces is a substantially pointed tip on said combined stem and spindle.

9. The combination of claim 8, wherein said gripping means is a substantially cylindrical portion of said combined stem and spindle.

10. The combination of claim 9, wherein said game pieces are made from plastic.

11. The combination of claim 1, wherein at least some of said game pieces create moving obstacles on said playing surface.

12. A method of playing a game which includes a smooth, obstacle-free playing surface and a plurality of game pieces, each game piece including a body and a combined stem and spindle which extends outwardly from one side of said body and which includes engaging means for engaging said playing surface and gripping means for gripping by a person between his or her thumb and finger, said method comprising the steps of:

(a) having a first player grip said gripping means of a first game piece between his or her thumb and finger;

(b) twirling said gripping means of said first game piece between said thumb and finger of said first player, whereby a spinning motion is imparted to said first game piece;

(c) projecting said first game piece onto said playing surface as said first game piece continues to spin; and (d) successively and sequentially repeating steps (a)–(c) for a plurality of additional game pieces over a predetermined playing period, whereby said first game piece and each of said additional game pieces create obstacles on said playing surface.

13. The method of claim 12, wherein said playing period terminates upon the expiration of a preselected length of time.

14. The method of claim 13, further comprising the step of repeating steps (a)–(d) for at least one of said game pieces which has stopped spinning.

15. The method of claim 12, wherein said playing period terminates when one of said game pieces stops spinning.

16. The method of claim 12, wherein said playing period terminates when a predetermined number of game pieces have been put into play.

17. The method of claim 12, wherein said first game piece and said plurality of additional game pieces are from a first set of game pieces.

18. The method of claim 17, further comprising the steps of:

(e) having a second player grip said gripping means of a first game piece of a second set of game pieces between his or her thumb and finger;

(f) twirling said gripping means of said first game piece of said second set of game pieces between said thumb and finger of said second player, whereby a spinning motion is imparted to said first game piece of said second set of game pieces;

(g) projecting said first game piece of said second set of game pieces onto said playing surface as said first game piece of said second set of game pieces continues to spin; and (h) successively and sequentially repeating steps (e)–(g) for a plurality of additional game pieces of said second set of game pieces over the same playing period that steps (a)–(d) are performed, whereby said game pieces of said first and second sets of game pieces are spinning on said playing surface simultaneously to thereby create obstacles on said playing surface.

19. The method of claim 18, wherein said first player repeats steps (a)–(c) for at least one of said game pieces of said first set of game pieces which has stopped spinning.

20. The method of claim 19 wherein said playing period terminates upon the expiration of a preselected length of time.

21. The method of claim 18 wherein said playing period terminates when one of said game pieces stops spinning.

22. The method of claim 18, wherein said game pieces of said first set of game pieces can be differentiated from said game pieces of said second set of game pieces.

23. The method of claim 18, wherein said playing period terminates when a predetermined number of game pieces have been put into play.

24. The method of claim 18, wherein at least some of said game pieces of said first set of game pieces and at least some of said game pieces of said second set of game pieces create moving obstacles on said playing surface.

25. The method of claim 18, wherein the game is won by the player who maintains the most game pieces in concurrent spinning motion.

26. The method of claim 12, wherein at least some of said game pieces create moving obstacles on said playing surface.

27. The method of claim 12, wherein the game is won by the player who maintains the most game pieces in concurrent spinning motion.

* * * * *